US008547802B2

(12) United States Patent
Hiranuma

(10) Patent No.: US 8,547,802 B2
(45) Date of Patent: Oct. 1, 2013

(54) TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 10 days.

(21) Appl. No.: 13/414,776

(22) Filed: Mar. 8, 2012

(65) Prior Publication Data

US 2012/0257481 A1 Oct. 11, 2012

(30) Foreign Application Priority Data

Mar. 10, 2011 (JP) ..... 2011-053461

(51) Int. Cl.
*G04B 1/00* (2006.01)

(52) U.S. Cl.
USPC ..... 368/205

(58) Field of Classification Search
USPC ..... 368/205, 223, 228, 232, 236, 239, 368/243, 287, 294, 295, 297, 299, 300
See application file for complete search history.

(56) References Cited

U.S. PATENT DOCUMENTS 4,207,735 A * 6/1980 Ishigaki et al. ..... 368/300
6,456,569 B1 * 9/2002 Stauffer ..... 368/236
6,575,619 B1 * 6/2003 Stauffer ..... 368/299

FOREIGN PATENT DOCUMENTS

JP 2001194470 7/2001

* cited by examiner

*Primary Examiner* — Edwin A. Leon
(74) *Attorney, Agent, or Firm* — Adams & Wilks

(57) ABSTRACT

A timepiece includes a movement, a ring member, and an hour plate. Upward engagement convex portions of the ring member have contact parts placed near an outer peripheral surface of the ring member. The hour plate has a plurality of interposition portions and a plurality of convex portion accommodation grooves opened to the peripheral surface thereof. The interposition portions divide the convex portion accommodation grooves, come into close contact with the contact parts in the state of being elastically deformed, and interpose the engagement convex portions therebetween along a direction perpendicular to a radial direction of the ring member. The convex portion accommodation grooves are housed in the respective engagement convex portions, and the hour plate is attached to the ring member.

11 Claims, 8 Drawing Sheets

TIMEPIECE

BACKGROUND OF THE INVENTION

1. Field of the Invention

The present invention relates to a timepiece such as a wristwatch in which a panel for an electricity generation or a light emission is provided in a module displaying a time or the like and the panel is covered with a display plate. Particularly, the present invention relates to a timepiece in which an attachment configuration of the display plate is improved.

2. Description of the Related Art

A timepiece is known as a related art in which a panel including a solar cell or an electroluminescence and a light-transmissive display plate covering the same are disposed on the module (for example, see Japanese Patent No. 4398555 (Patent Document 1)).

In the related art, an auxiliary ring formed of a resin molding product has a pair of cylindrical projection portions in a plurality of locations on an upper surface of an outer peripheral portion thereof, respectively, and has a projection on a lower surface thereof. The projections of the auxiliary ring are engaged with the module, and the auxiliary ring is fixed to the module. With this, the display plate is formed in a thin plate shape by a synthetic resin such as a transparent acrylic resin or a polycarbonate resin, and has a plurality of notches in a peripheral portion thereof. By engaging the notches with the cylindrical projection portions of the module, the display plate is fixed to the auxiliary ring.

Specifically, the pair of cylindrical projection portions has a gap therebetween and is formed so as to be elastically deformable toward the gap. The notches of the display plate elastically deform a pair of cylindrical projection portions placed inside thereof in a direction approaching each other and are engaged with them. As a result, it is possible to fix the display plate in the state in which a lateral deviation or rotation is prevented.

In a timepiece according to the related art, since a length of a cylindrical projection portion based on the upper surface of the outer peripheral portion of the auxiliary ring is short, the elastic deformation of the cylindrical projection portion is not easy but rather difficult. In other words, a resilience of the cylindrical projection portion is extremely low. For this reason, a work of engaging the notches with the cylindrical projection portion while elastically deforming the same and attaching the display plate to the auxiliary ring is troublesome.

In the assembly of the timepiece, when the mounting of the display plate onto the auxiliary ring is bad or the like, after removing the display plate, a reinstalling work is performed or a work of replacing the display plate with a new one. This work is called a rearrangement of the display plate.

In the rearrangement work, firstly, there is a need to remove the display plate of the misattachment from the upper portion of the module by the use of a tool such as a pincers. In this case, since the elastic deformation of a cylindrical convex portion is difficult as described above, a work of removing the display plate of the misattachment is also naturally troublesome.

In this manner, in the timepiece of the related art, it is difficult to easily attach and detach the display plate to and from the auxiliary ring. Furthermore, the cylindrical projection portion, which has a short length and is not easily elastically deformed, is easily bent exceeding the elastic limit due to the attachment of the display plate. When leading to such a situation, even if the rearrangement of the display plate is performed, it is difficult to suitably attach the display plate, and there is a high possibility of causing a misattachment of the display plate due to the rearrangement.

That is, the related art has a problem in that the attachment work of the display plate to the auxiliary ring and the rearrangement work of the display plate are troublesome, and there is a high possibility that the misattachment of the display plate due to the rearrangement of the display plate is generated.

SUMMARY OF THE INVENTION

In order to solve the problem, according to the present invention, there is provided a timepiece which includes a module; a panel fixed onto the module; a ring member of a ring shape when viewed from a plane that is fixed to a peripheral portion of the module, convex engagement convex portions being formed in a plurality of locations of the ring member, and the engagement convex portions having contact parts that are placed near the outer peripheral surface of the ring member; a display plate that is disposed so as to cover the panel, has a plurality of convex portion accommodation grooves opened to the peripheral surface of the display plate, and a plurality of interposition portions which divides the accommodation grooves, comes into close contact with the contact part in the state of being elastically deformed, and interposes the engagement convex portions therebetween along a direction perpendicular to a radial direction of the ring member, the respective convex portion accommodation grooves being housed in the respective engagement convex portions and the display plate being attached to the ring member.

In the present invention, when the module is implemented as an analog type timepiece, the module indicates a movement which drives a plurality of time display needles, and when being implemented as a digital type timepiece, the module indicates an electronic circuit which drives a display showing the time or the like. In the present invention, the panel indicates a solar battery panel, a light emitting panel or the like.

In the present invention, the engagement convex portion interposed by the interposition portion may be a single convex portion, may be a pair of convex portions arranged parallel to the groove bottom surface of the convex portion accommodation groove, in the case if the single engagement convex portion of the former, the engagement convex portion has contact parts at both side portions in a width direction thereof, and in the case of the pair of engagement convex portions of the latter, each of the engagement convex portions have the single contact part, respectively. Furthermore, the contact part may be a part of the peripheral surface of the engagement convex portion, and may be a bead protruded from the peripheral surface. Furthermore, in the present invention, the expression "the contact part is placed near the outer peripheral surface of the ring member" means that the contact part is provided in a position as close as possible to the outer peripheral surface of the ring member, in other words, so as to be farthest separated from the groove bottom surface of the convex portion accommodation groove.

In the present invention, the convex portion accommodation groove may have a configuration in which the groove width thereof is not changed, but may be formed so that the groove width is narrowed as going to an outer peripheral side of the display plate as a preferred aspect described later. In the present invention, like a preferred aspect described later, providing a relief groove in the display plate is not prevented, but it is also possible to omit the relief groove.

Furthermore, in the present invention, when being implemented as an analog type timepiece, the display plate indicates a transparent hour plate, and when being implanted as a digital type timepiece, the display plate has a window facing a desired part of a display indicating the time or the like, and a part other than the window indicates a cover plate (in addition, the plate is known as a clearance plate) that covers the display.

In the present invention, the engagement convex portions of the ring member are housed in the concave portion accommodation grooves of the display plate, respectively, and, by the interposition portion of the display plate that comes into close contact with the contact part of the engagement convex portion in the state of being elastically deformed, the engagement convex portion is interposed therebetween along a direction perpendicular to the radial direction of the ring member, and the display plate is attached to the ring member. In this manner, since the interposition portion of the display plate is elastically deformed and the display plate is attached to the ring member, it is possible to suppress that the engagement convex portion is incorrectly elastically deformed.

Since a board thickness of the display plate is approximately as thin as the height of the engagement convex portion, the elastic deformation of the display plate is easier than the engagement convex portion. Furthermore, since the contact part, with which the interposition portion of the display plate comes into close contact, is provided in the engagement convex portion near the outer peripheral surface side of the ring member, it is possible to lengthen a length from a root of the interposition portion up to the close-contact location to the contact part. As a result, it is possible to mainly easily elastically deform the interposition portion to attach and detach the display plate to and from the ring member, while suppressing that the engagement convex portion is unjustly deformed.

Thus, in the present invention, it is easy to perform an attachment work of the display plate to the ring member and a rearrangement work of the display plate, and it is possible to suppress the misattachment of the display plate due to the rearrangement of the display plate.

In a preferred aspect of the present invention, the convex portion accommodation grooves are formed so that a distance between the interposition portions with the engagement convex portion interposed therebetween is narrowed as going to a peripheral surface side of the display plate. In the preferred aspect of the invention, in order that the distance between the interposition portions is narrowed as going to the peripheral surface side of the display plate, the surface facing at least one convex portion accommodation groove among interposition portions with the engagement convex portion therebetween may be tilted.

In the invention of the preferred aspect, even if the display plate attached to the ring member tries to move in the radial direction, in the engagement convex portion situated at an opposite side of the movement direction and the convex portion accommodation groove with the engagement convex portion housed therein, the engagement convex portion functions as a stopper, whereby the close-contact between the engagement convex portion and the interposition portion with the same interposed therebetween is strengthened. Furthermore, owing to the stopper function, there is no problem even when force by which the interposition portion comes into close contact with the contact part of the engagement convex portion may be small, and thus, the elastic deformation of the interposition portion when attaching and detaching the display plate to and from the ring member becomes easier. As a consequence, there is a further advantage in that the attachment and detachment work of the display plate can more easily be performed. In addition, upon narrowing the convex portion accommodation groove by the opening end side thereof, when titling the interposition portions with the engagement convex portion interposed therebetween, respectively, as the interposition portions are lengthened, the elastic deformation of the interposition portion becomes easier, and thus, it is more preferable in that the attachment and detachment operation of the display plate becomes easier.

In the preferred aspect of the present invention, the display plate further has a plurality of relief grooves opened to the peripheral surface of the display plate, and portions between the relief grooves and the convex portion accommodation grooves are the interposition portions. In the invention of the preferred aspect, the depth of the relief groove may be approximately the same as that of the convex portion accommodation groove and may be shorter than that.

In the invention of the preferred aspect, when the display plate is attached or detached, since the interposition portion is elastically deformed while escaping to the relief groove side, the elastic deformation of the interposition portion becomes easier, and, consequentially, there is a further advantage in that it is possible to more easily perform the attachment and detachment work of the display plate. Furthermore, there is a further advantage in that, since the elastic deformation of the interposition portion becomes easier, it is possible to suppress that an excessive reaction force enough to deform the same in an undulate manner is given to the hour plate, by the interposition portion with the engagement convex portion interposed therebetween.

In the preferred aspect of the present invention, the engagement convex portion is approximately square when viewed from the plane and is solid.

In the preferred invention, since the engagement convex portion is solid, when the display plate is attached and detached, the engagement convex portion is difficult to deform, and thus, there is a further advantage in that it is possible to suppress that the misattachment of the display plate due to the rearrangement of the display plate.

In the preferred aspect of the present invention, the engagement convex portions have an inner space portion that has an approximately square shape when viewed from a plane and is opened to the upper end.

The invention of the preferred aspect has a further advantage in that, when the display plate is attached and detached, in addition to the elastic deformation of the interposition portion, the engagement convex portion having the inner space portion can be bent, and, it is possible to more easily perform the attachment and detachment work of the display plate.

In the preferred aspect of the present invention, the engagement convex portion has a wall portion which faces the groove bottom surface of the convex portion accommodation groove, and another wall portion which is continued so as to be bent from both end portions of the wall portion in a width direction toward the open end of the convex portion accommodation groove, and the contact part is provided in another wall portion.

The invention of the preferred aspect has a further advantage in that, it is possible that another wall portion provided with the contact part of the engagement convex portion can be bent in the interposition direction of the interposition portion in addition to the elastic deformation of the interposition portion, and it is possible to more easily perform the attachment and detachment work of the display plate.

In the preferred aspect of the present invention, the engagement convex portion is formed by a plate-like wall that is parallel to the groove bottom surface of the convex portion accommodation groove and can be elastically deformed in the radial direction of the ring member.

In the invention of the preferred aspect, when the display plate is attached and detached, in addition to the elastic deformation of the interposition portion, the engagement convex portion can be elastically deformed in the radial direction of the ring member, and thus, it is possible to more easily perform the attachment and detachment work of the display plate. Furthermore, there is a further advantage in that the configuration of the engagement convex portion is simple, and thus, it is possible to reduce the die cost of the molding die of the ring member.

In the preferred aspect of the present invention, the engagement convex portion comes into contact with the groove bottom surface of the convex portion accommodation groove.

The invention of the preferred aspect has a further advantage in that the engagement convex portion as a stopper suppresses that the display plate attached to the ring member tries to move in the radial direction, by the contact between the engagement convex portion and the groove bottom surface of the convex portion accommodation groove, and it is possible to hold the display plate so as not to roll.

In the preferred aspect of the present invention, the ring member further includes an upward restriction convex portion that is provided between the groove bottom surface of the convex portion accommodation groove and the engagement convex portion, can be elastically deformed in the radial direction of the ring member, and comes into contact with the groove bottom surface of the convex portion accommodation groove.

The invention of the preferred aspect has a further advantage in that the restriction convex portion as a stopper suppresses that the display plate attached to the ring member tries to move in the radial direction, by the contact between the upward restriction convex portion provided in the ring member and the groove bottom surface of the convex portion accommodation groove, and it is possible to hold the display plate so as not to rattle.

In the preferred aspect of the present invention, the panel is a solar battery panel that generates electricity by a photoelectric conversion.

The invention of the preferred aspect has a further advantage in that the electric power to be supplied to the module or the like, for example, driven by the electric power can be generated by the solar battery panel that receives light transmitted through the display plate.

In a preferred aspect of the present invention, the panel is a light emitting panel that emits light in an electrically conducted state.

The invention of the preferred aspect has a further advantage in that the light emitting panel emits light by the electric conduction thereto and a backlight illumination to the display plate is possible, and thus, visibility of the display of the time or the like can be further improved.

According to the timepiece of the present invention, it is possible to expect an effect that the attachment work of the display plate to the ring member and the rearrangement work of the display plate are easy, and the misattachment of the display plate due to the rearrangement of the display plate can be suppressed.

DETAILED DESCRIPTION OF THE PREFERRED EMBODIMENTS

Hereinafter, a first embodiment of the present invention will be described with reference to FIGS. 1 to 6 in detail.

Figure 1:
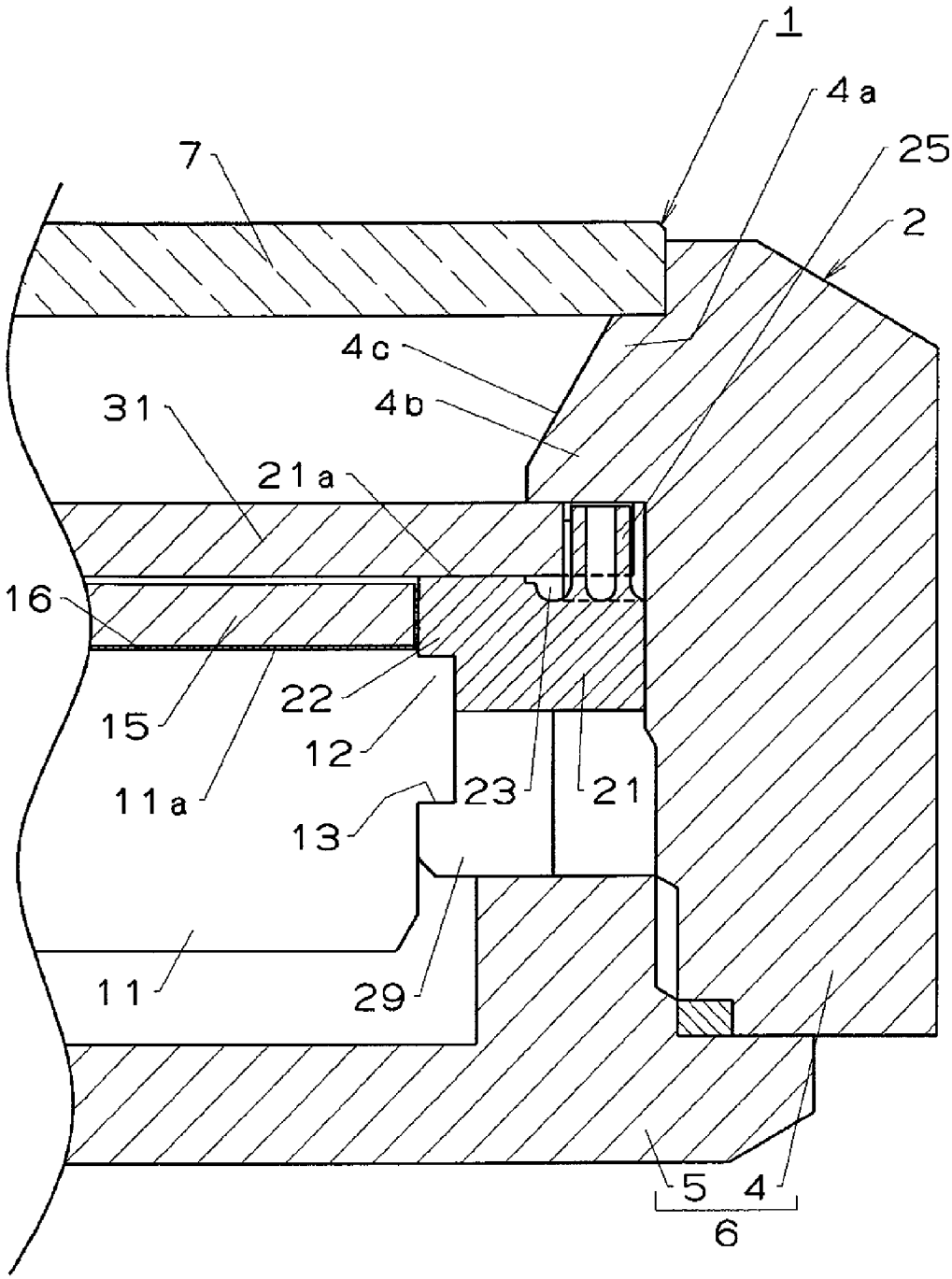
FIG. 1 is a cross-sectional view that shows a part of a wristwatch according to a first embodiment of the present invention.

Reference numeral 1 in FIG. 1 shows a timepiece, for example, a portable timepiece, specifically, a wristwatch. The wristwatch 1 includes a timepiece exterior assembly 2, a module, for example, a movement 11, a panel, for example, a solar battery panel 15, a ring member 21, and a display plate, for example, an hour plate 31.

The timepiece exterior assembly 2 includes an exterior member 6 made of a metal or a synthetic resin having a body 4 and a back cover 5, and a cover glass 7. The back cover 5 is screwed and connected to the body 4. In addition, the exterior member 6 may have one-piece type configuration in which the body 4 and the back cover 5 are integrally formed. The cover glass 7 is mounted inside a glass support portion 4*a* formed in the body 4 in a liquid-tight manner.

The exterior member 6 has a clearance 4*b*. The clearance 4*b* shown in FIG. 1 is integrally formed in an inner periphery of the body 4 but may be a ring-shaped member molded separately from the body 4. The clearance 4*b* has a slope surface 4*c*, and the slope surface 4*c* faces a peripheral portion back surface of the cover glass 7.

The movement 11 is driven by the electric power generated by a solar battery panel 15 described later, and includes a secondary battery for accumulating the electric power, a capacitor or the like (not shown). The movement 11 has a circular shape when viewed from a plane. The movement 11 is incorporated in the timepiece exterior assembly 2 together with a ring member 21, an hour plate 31 or the like described later.

The movement 11 has an engagement portion 12. The engagement portion 12 is provided at an upper surface 11*a* side in a peripheral portion of the movement 11, and, for example, is formed in an upper surface part of a ring-shaped convex portion continued in a circumferential direction of the movement 11. As shown in FIG. 1, the engagement portion 12 is slightly retreated in a back side (a lower side) of the movement 11 with respect to the upper surface 11*a* of the movement 11.

The solar battery panel 15 is a panel in which a solar cell (not shown) as an electricity generation element generating electricity by the photoelectric conversion is mounted on a substrate (not shown). The solar cell may be a crystal system or an amorphous system. The solar battery panel 15 has a diameter slightly smaller than that of the movement 11, and is fixed to the upper surface 11*a* of the movement 11 by the use of a bonding member 16. As the bonding member 16, it is possible to very suitably use a double-sided adhesive tape in which both sides thereof have adhesiveness.

The ring member 21 is formed of a synthetic resin, for example, an integrated molded product of Duracon. The ring member 21 forms a ring shape when viewed from a plane, an inner diameter thereof is slightly greater than the diameter of the solar battery panel 15, and an outer diameter thereof is greater than the diameter of the movement 11. The ring member 21 has engagement grooves 22 that are opened to the inner surface and the back surface (a lower surface) thereof. The engagement grooves 22 are continuously formed in the circumferential direction ring member 21 in a ring shape.

Furthermore, the ring member 21 has hollows 23 and engagement convex portions 25 having the same number as that on the upper surface 21*a* in a plurality of locations, and also has hook portions 29 (only one is shown in FIG. 1) in a plurality of locations of the back surface.

Figure 2:
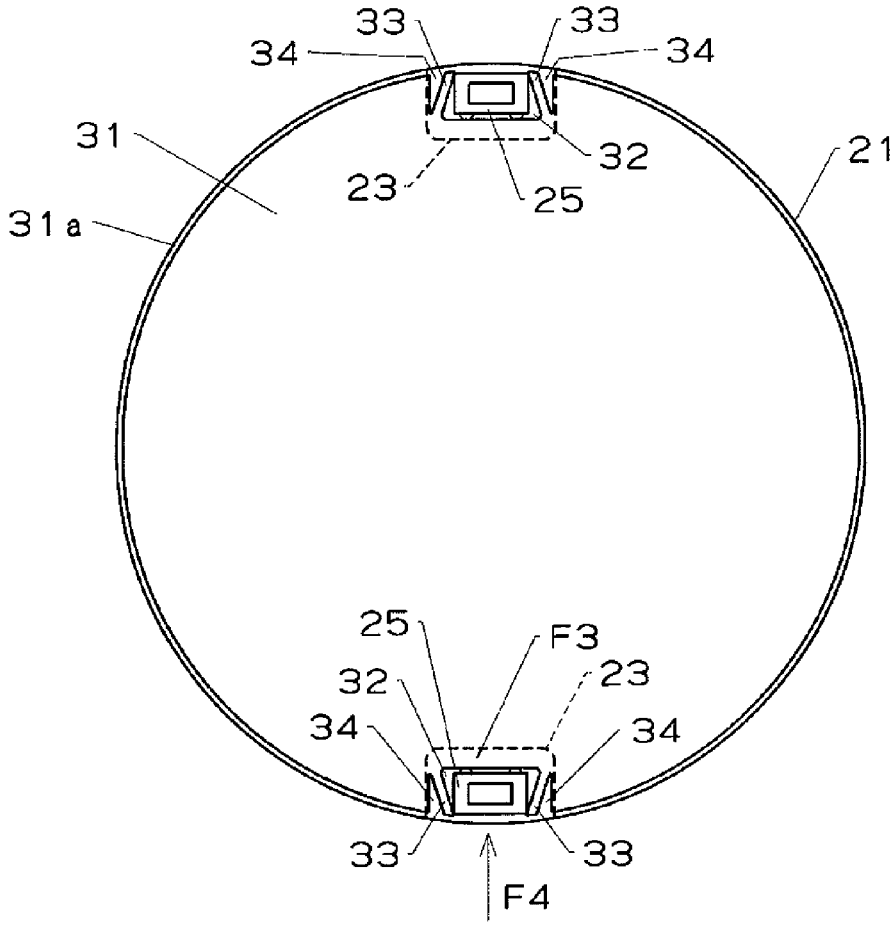
FIG. 2 is a schematic plan view that shows a relationship between a solar battery panel disposed on a movement included in the wristwatch of FIG. 1 and a hour plate.
Figure 4:
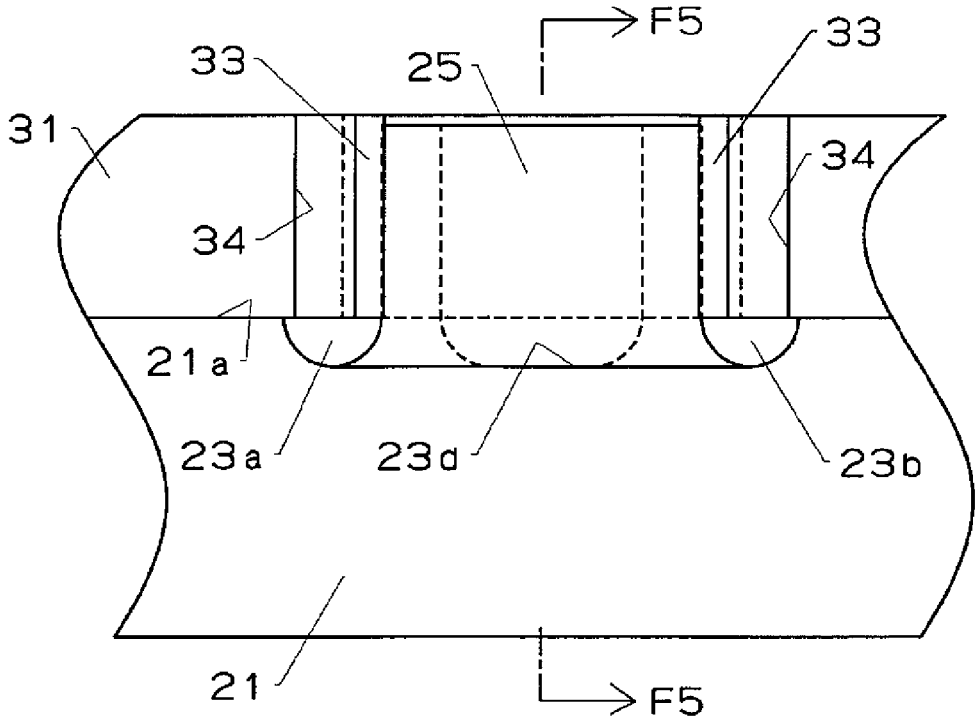
FIG. 4 is a side view of a F3 portion viewed from an arrow F4 line direction in FIG. 2.
Figure 5:
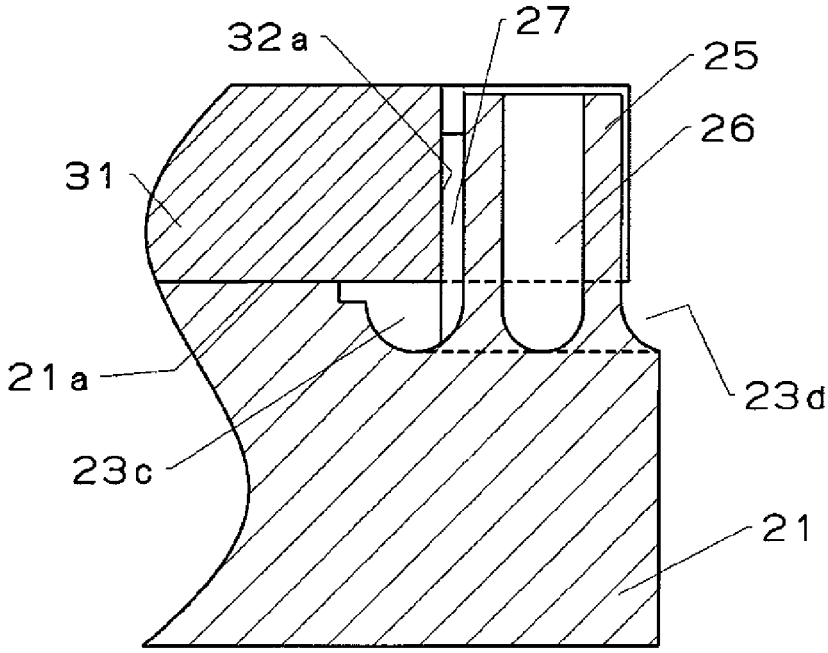
FIG. 5 is a cross-sectional view taken along line F5-F5 in FIG. 4.

As shown in FIG. 2, the hollows 23 are provided in two locations of the outer peripheral portion of the ring member 21, for example, so as to be separated by 180°. Furthermore, the hollows 23 may be provided in three locations for each 120°, or may be provided in four locations for each 90°. The respective hollows 23 are opened to the upper surface 21*a* and the outer peripheral surface of the ring member 21, respectively, and have a first hollow part 23*a* to a fourth hollow part 23*d* as shown in FIGS. 4 to 5.

The first hollow part 23*a* is parallel to the second hollow part 23*b*. Both of one ends of the first hollow part 23*a* and the second hollow part 23*b* are opened to the outer peripheral surface of the ring member 21. The third hollow part 23*c* is provided over the other ends of the first hollow part 23*a* and the second hollow part 23*b*. The fourth hollow part 23*d* is provided over one end portions of the first hollow part 23*a* and the second hollow part 23*b*, and is opened to the outer peripheral surface of the ring member 21 all over a longitudinal direction thereof. Thus, the first hollow part 23*a* to the fourth hollow part 23*d* form, for example, an approximately square ring shape and are continued.

The engagement convex portion 25 is protruded integrally upward from the bottom of each hollow 23. For that reason, the whole root portion of the engagement convex portion 25 is situated at a lower side from the upper surface 21*a* of the ring member 21, and the root portion is surrounded by the first hollow portion 23*a* to the fourth hollow portion 23*d* that are continued in a ring shape as described.

Figure 3:
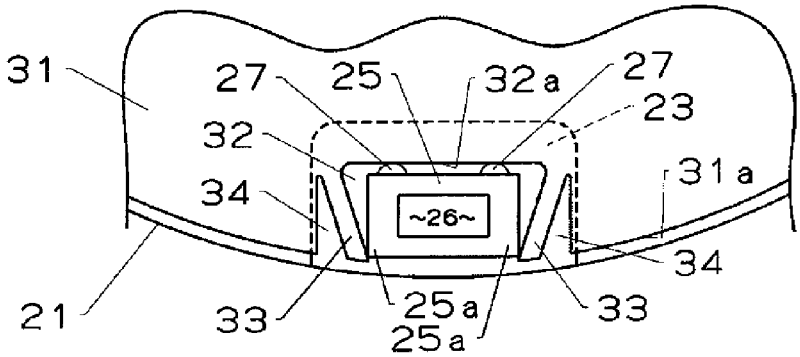
FIG. 3 is an enlarged plan view that shows a F3 portion in FIG. 2.

The respective engagement convex portions 25 have approximately square shape when viewed from a plane as shown in FIG. 3, and have an inner space portion 26 opened to the upper end. The engagement convex portions 25 are provided so that a side forming a long side thereof is perpendicular to the radial direction of the ring member 21. Two corners of a side close to the open end of a convex portion accommodation groove 32 described below, in other words, two corners of the engagement convex portions 25 close to the outer periphery of the ring member 21 are used as contact parts 25*a* (see FIG. 3), respectively.

As shown in FIG. 4, the first hollow part 23*a* to the third hollow portion 23*c* are recessed and formed in a semicircular shape, and, as shown in FIG. 5, the fourth hollow part 23*d* is recessed and formed so as to form an arc shape of ¼. For that reason, the side surface of the root portion of the engagement convex portion 25 and the hollow 23 are continued without forming an angle between them, whereby the engagement convex portion 25 is gradually thicker toward the bottom of the hollow 23.

As shown in FIGS. 3 and 5, the engagement convex portion 25 has, for example, two beads 27 at a side surface situated farthest from the outer periphery of the ring member 21. The beads 27 are constituted by convex portions having an arc shape when viewed from a plane. The beads 27 are extended so as to be parallel to the extension direction of a center axis (not shown) of the engagement convex portion 25. As shown in FIG. 5, the upper ends of the beads 27 slightly fall from the upper end of the engagement convex portion 25, and the lower ends of the beads 27 reach the root portion of the engagement convex portion 25.

As shown in FIG. 1, the ring member 21 is attached to the movement 11 so that a hook portion 29 is hooked to a lower surface 13 of the annular convex portion of the movement 11, and the engagement groove 22 is engaged with the upper surface of the engagement portion 12. By the attachment mentioned above, the hollow 23 separated by 180° is located in a direction of 12 o'clock-6 o'clock as described in FIG. 2, and the upper surface 21*a* of the ring member 21 except for the respective engagement convex portions 25 is situated so as to be slightly higher than the upper surface of the solar battery panel 15 (see FIG. 1). In addition, the placement of the pair of hollows 23 is not limited to the direction of 12 o'clock-6 o'clock, but it is also possible to place the pair of hollows 23 in a direction of 9 o'clock-3 o'clock or other directions.

The hour plate 31 is molded in a thin plate shape by a translucency material such as a transparent acrylic resin or a polycarbonate resin and a synthetic resin harder than a synthetic resin material which molds the ring member 21. The hour plate 31 has an approximately circular shape and has a diameter that is slightly smaller than an outer diameter of the ring member 21. In the hour plate 31, although it is not shown, displays such as graduations, numbers, and patterns are provided.

Figure 6:
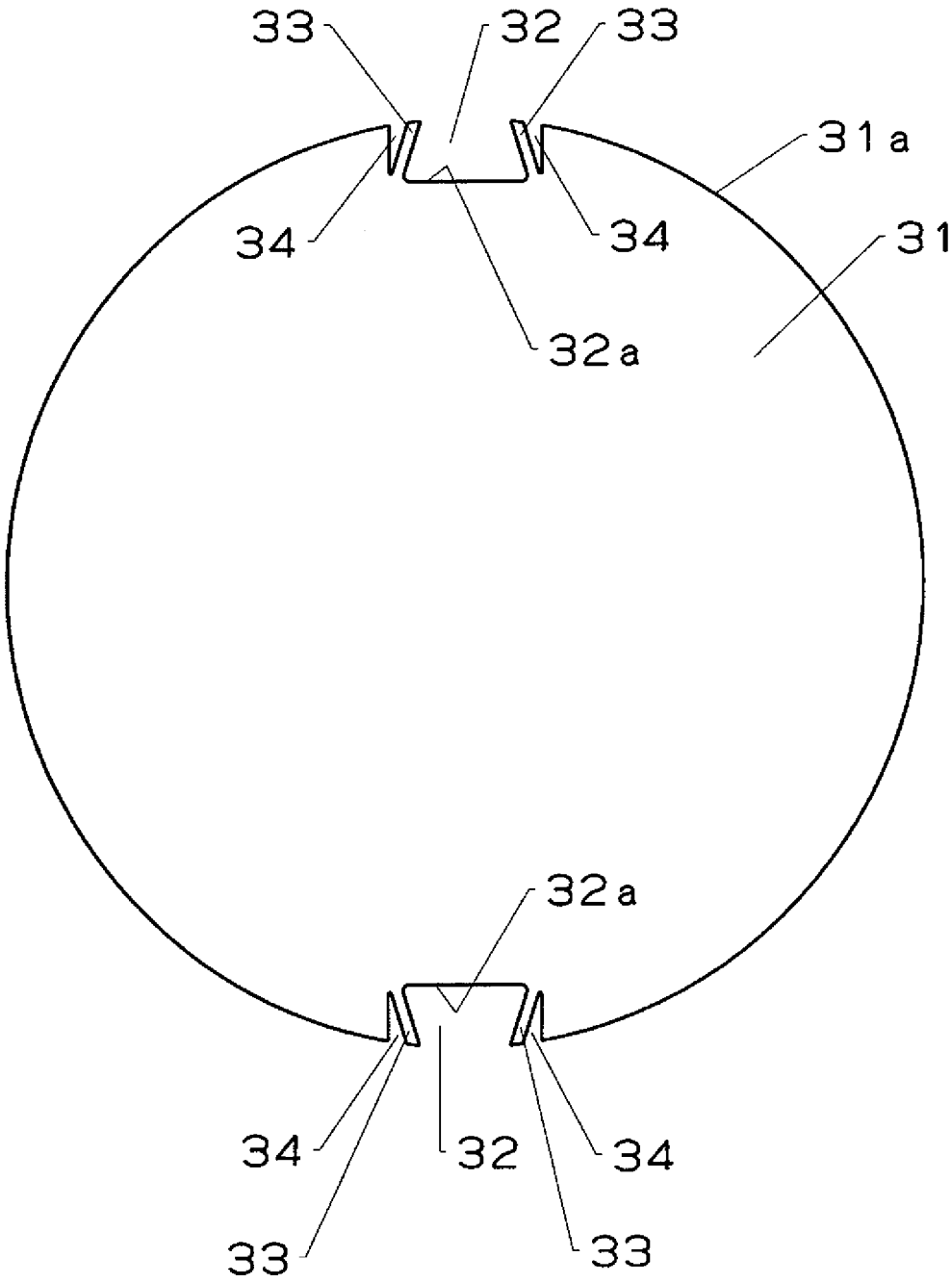
FIG. 6 is a plan view that shows a hour plate included in the wristwatch of FIG. 1.

The hour plate 31 has a plurality of convex portion accommodation grooves 32 in the peripheral portion. The convex portion accommodation grooves 32 are formed so as to notch the hour plate 31 from the peripheral surface thereof, and are opened to the peripheral surface 31*a* of the hour plate 31. The end which is opened is hereafter called an "open end". The respective convex portion accommodation grooves 32 have the same numbers as those of the engagement convex portions 25, and are provided so as to comply with the placement of the engagement convex portions 25. Thus, as shown in FIG. 6, two convex portion accommodation grooves 32 are provided so as to be separated in the circumferential direction of the hour plate 31 by 180°.

Both sides of the convex portion accommodation grooves 32 in a width direction are partitioned by an interposition portion 33 as shown in FIG. 3. The interposition portion 33 can be elastically deformed. A width of the convex portion accommodation groove 32, that is, a distance between the interposition portions 33 is formed so as to be narrowed by an opening end side of the convex portion accommodation groove 32, in other words, the peripheral surface 31*a* of the hour plate 31. For that reason, in the case of the first embodiment, the interposition portions 33 slopes so that the interposition portions 33 approach each other by the peripheral surface 31*a* side of the hour plate 31. Furthermore, the slope may be provided only in one interposition portion 33. The distance between tip portions of the interposition portions 33 partitioned the convex portion accommodation groove 32, in other words, a width of the opening end portion, which is a minimum width of the convex portion accommodation groove 32, is slightly narrower than a separated distance between two contact parts 25*a* of the engagement convex portion 25.

The hour plate 31 is attached to the ring member 21 so as to cover the solar battery panel 15. The attachment can be performed by pressing the hour plate 31 downward from the upper part of the ring member 21 in the state of positioning the engagement convex portion 25 and the convex portion accommodation groove 32 of the hour plate 31 with respect to the ring member 21 that is mounted on the movement 11.

As a result, while the interposition portions 33 causes a deflection deformation (a bending deformation) mainly in the thickness direction of the hour plate 31, the convex portion accommodation groove 32 is fitted to the engagement convex portion 25. That is, due to the fact that the engagement convex portion 25 is relatively lightly pressed to the convex portion accommodation groove 32, the interposition portions 33 come into close contact with the contact part 25*a* of the engagement convex portion 25, and the interposition portions 33 interpose the engagement convex portion 25 therebetween along a direction perpendicular to the radial direction of the ring member 21 as shown in FIG. 3 or the like. Along with this, the beads 27 come into contact with the groove bottom surface 32*a* of the convex portion accommodation groove 32.

While the state is kept, the back surface of the hour plate 31 comes into contact with the upper surface 21*a* of the ring member 21, whereby the pressing operation is prevented. As a result, the respective engagement convex portions 25 can be housed in the respective convex portion accommodation grooves 32 corresponding thereto, respectively, and the hour plate 31 is attached to the ring member 21 so as to cover the solar battery panel 15.

In this case, the contact parts 25*a*, with which the interposition portions 33 come into close contact, are provided in the engagement convex portions 25 near the outer peripheral surface side of the ring member 21, and thus, a length from the root from interposition portion 33 to the close location to the contact part 25*a* is long. In addition, the interposition portions 33 slope so as to approach each other by the tip sides thereof so that the width of the convex portion accommodation groove 32 is gradually narrowed toward the open end of the groove. Thus, it is possible to lengthen the lengths from the bases of the interposition portions 33 to the contact parts 25*a*, compared to a configuration in which the width of the convex portion accommodation groove 32 is not changed.

As a result, in the attachment operation of the hour plate 31 mentioned above, the hour plate 31 can be attached to the ring member 21, mainly, by easily elastically deforming the interposition portions 33 in the thickness direction of the hour plate 31, and at that time, the engagement convex portion 25 is not unjustly deformed by using the root portion thereof as a support point.

In addition, since the engagement convex portion 25 have an inner space portion 26 opened to the upper end thereof, when the hour plate 31 is attached, in a case where great force is applied to the engagement convex portion 25, the engagement convex portion 25 can be slightly bent so that the diameter thereof is reduced. For this reason, it is possible to more easily perform the attachment work of the hour plate 31 to the ring member 21, while not causing the engagement convex portion 25 to be bent from the bases thereof.

Furthermore, the root portion of the engagement convex portion 25 is formed to be thicker than the upper side part further than that, but the root portion is situated at the lower side from the upper surface 21*a* of the ring member 21. For that reason, in the attachment of the hour plate 31 mentioned above, the root portion of the engagement convex portion 25 does not interfere with the back surface of the hour plate 31 coming into contact with the upper surface 21*a* of the ring member 21.

As shown in FIGS. 3, 6 or the like, the hour plate 31 has a plurality of relief grooves 34 opened to the peripheral surface thereof. The interposition portion 33 is situated between the relief groove 34 and the convex portion accommodation groove 32. The respective relief grooves 34 are formed so as to notch the peripheral portion of the hour plate 31, for example, in a V shape. The depth thereof is, for example, approximately the same as the depth of the convex portion accommodation groove 32. The root portion of the interposition portion 33 is situated between the inner corner of the convex portion accommodation groove 32 and the inner portion of the relief groove 34, and the interposition portion 33 can be elastically deformed in a direction narrowing the width of the relief groove 34 using the root portion as the support point.

For this reason, when the hour plate 31 is attached, the interposition portion 33 can also be elastically deformed while escaping to the relief groove 34 side, and the interposition portion 33 is more easily elastically deformed. As a consequence, it is possible to more easily perform the attachment work of the hour plate 31 to the ring member 21, while suppressing the deformation of the engagement convex portion 25.

As the attachment mentioned above, the hour plate 31 is held so as not to rattle.

That is, since the interposition portion 33 of the hour plate 31 elastically comes into close contact with the engagement convex portion 25 of the ring member 21, it is possible to hold the hour plate 31 so as not to rattle in the circumferential direction thereof. Furthermore, since the width of the convex portion accommodation groove 32 is gradually narrowed toward the open end of the groove, even if the hour plate 31 attached to the ring member 21 tries to be moved in the radial direction connecting the convex portion accommodation groove 32, in the engagement convex portion 25 situated at the opposite side of the movement direction and the convex portion accommodation groove 32 with the same housed therein, the engagement convex portion 25 functions as a stopper, whereby the close-contact between the engagement convex portion 25 and the interposition portions 33 with the same interposed therebetween is reinforced. Along with this, since the bead 27 of the engagement convex portion 25 comes into contact with the groove bottom surface 32*a* of the convex portion accommodation groove 32, even if the hour plate 31 attached to the ring member 21 tries to be moved in the radial direction connecting the convex portion accommodation groove 32, the engagement convex portion 25 can be suppressed as the stopper. Thus, it is possible to hold the hour plate 31 so that the convex portion accommodation groove 32 does not rattle in the radial direction.

Furthermore, in the holding state, as shown in FIG. 3, between the slope interposition portion 33 and the side surface of the engagement convex portion 25 facing the same, a gap is formed which gradually spreads toward the groove bottom surface 32*a* of the convex portion accommodation groove 32 starting from the contact location between the tip portion of the interposition portion 33 and the contact part 25*a*.

As described above, the interposition portion 33 of the hour plate 31 is long, and by the relief groove 34 provided in the hour plate 31 so as to interpose the interposition portion between the same and the convex portion accommodation groove 32, the elastic deformation is easier. For this reason, it is suppressed that excessive reaction force enough to deform the hour plate 31 attached to the ring member 21 by the interposition portion 33 with the engagement convex portion 25 therebetween, and the force is absorbed by the elastic deformation of the interposition portion 33 so as to narrow the relief groove 34. Thus, it is possible to prevent a disadvantage of the case where the transparent hour plate 31 enters the rattled state using the convex portion accommodation groove 32 as the support point, that is, a disadvantage in that the reflections of light in each portion of the hour plate 31 are different from each other, the rattled state of the hour plate 31 can easily be visible, and the appearance of the wristwatch 1 is impaired.

Furthermore, as described above, since the engagement convex portion 25 has the stopper function, it is possible to reduce force by which the interposition portion 33 comes into close contact with the contact part 25*a* of the engagement convex portion 25. As a result, the elastic deformation of the interposition portion 33 when attaching the hour plate 31 to the ring member 21 becomes easier with the result that it is possible to more easily perform the attachment work of the hour plate 31.

The hour plate 31 attached in this manner faces the back surface of the cover glass 7 as shown in FIG. 1, and the peripheral portion of the hour plate 31 is covered with the clearance 4*b*. Since the hour plate 31 is transparent, natural light or artificial light transmitted through the cover glass 7 and the hour plate 31 is incident to the solar battery panel 15, and along with this, the solar cell of the solar battery panel 15 is subjected to the photoelectric conversion to generate electricity. Thus, the wristwatch 1 accumulates the electric power generated in this manner in a secondary battery or a capacitor, and can drive the movement 11 by the electric power.

Furthermore, the peripheral portion of the convex portion accommodation groove 32 of the hour plate 31 attached to the ring member 21 comes into contact with the upper surface 21*a* of the ring member 21 and covers the hollow 23, but, as shown in FIG. 4, the hollow 23 is opened to the outer peripheral surface of the ring member 21. For that reason, when the attachment of the hour plate 31 is bad and the rearrangement of the hour plate 31 is performed, or in a maintenance operation, in the case of removing the hour plate 31 from the ring member 21, it is possible to easily insert a tool (not shown) such as a pincer for removing the hour plate 31 from outside the ring member 21 to the first hollow part 23*a* or the second hollow part 23*b* of the hollow 23 or both of them.

As a result, after placing the tool behind the hour plate 31, it is possible to remove the hour plate 31 engaged with the engagement convex portion 25 of the ring member 21 by wrenching the same with the tool. In addition, the wrenching operation can be performed in a position near the engagement convex portion 25. In addition, as mentioned above, since the slope interposition portion 33 has the long overall length and the relief groove 34 is provided in the hour plate 31, the elastic deformation of the interposition portion 33 is easy, similar to when attaching the hour plate 31 to the ring member 21, and thus, there is no need for an excessive operation force in the wrenching operation. Thus, the hour plate 31 can easily be removed.

Furthermore, as mentioned above, since the engagement convex portion 25 is protruded upward from the bottom of the hollow 23 provided in the ring member 21, and the root portions of each engagement convex portion 25 are situated at the lower side from the upper surface 21*a* of the ring member 21, the overall length of each engagement convex portion 25 is long depending on the depth of the hollow 23. As a result, even if the engagement convex portion 25 is bent by the use of the root portion as the support portion, the elastic deformation thereof is relatively easy, and there is no concern that a crack is generated in the root portion of the engagement convex portion 25 caused by a stress concentration thereto at that time.

In addition, the root portion of the engagement convex portion 25 is formed so as to be gradually thicker toward the bottom of the hollow 23, the bottom of the hollow 23 and the peripheral surface of the root portion are continued without forming an angle between them, and an upper part from the root portion of the engagement convex portion 25 and the peripheral surface of the root portion are also continued without forming an angle between them. For this reason, since the stress is hardly concentrated in the root portion, a concern is reduced which causes a crack in the root portion of the engagement convex portion 25 by external force such as vibration applied to the wristwatch 1, and it is possible to reliably maintain a predetermined attachment state of the hour plate 31 to the ring member 21.

Figure 7:
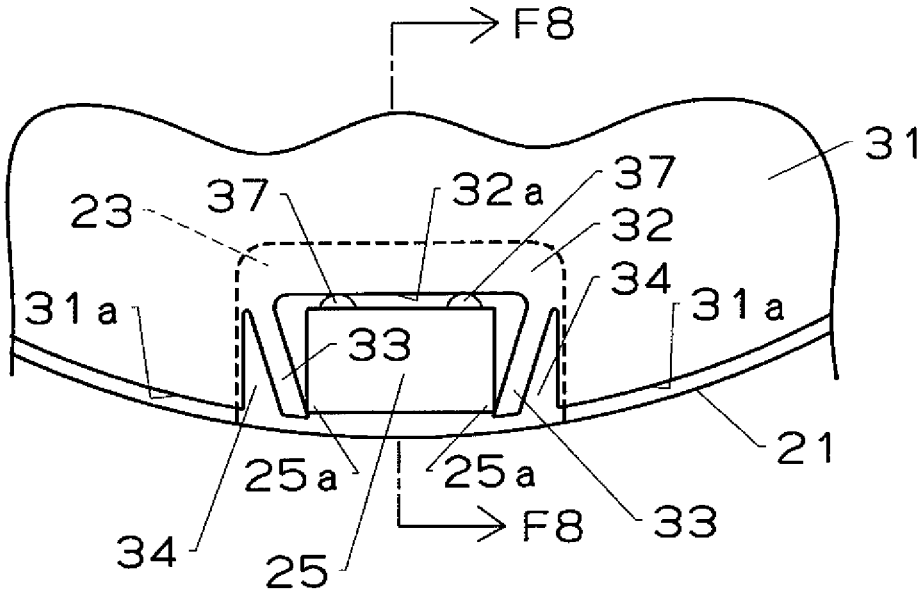
FIG. 7 is a plan view corresponding to FIG. 3 that shows a part of the wristwatch according to a second embodiment of the present invention.
Figure 8:
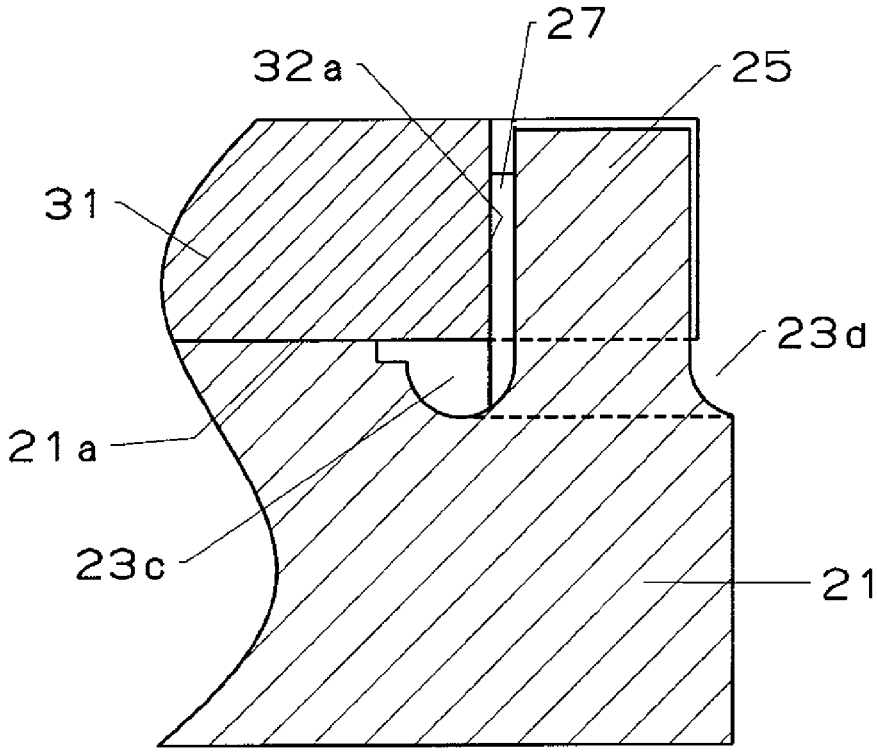
FIG. 8 is a cross-sectional view taken along line F8-F8 in FIG. 7.

FIGS. 7 and 8 show a second embodiment of the present invention. A wristwatch according to the second embodiment is the same as that of the first embodiment including a configuration not shown in FIGS. 7 and 8 except for a configuration described below. For that reason, the same configurations as that of the first embodiment are denoted by the same reference numerals as the first embodiment, and the descriptions thereof will be omitted.

In the second embodiment, the engagement convex portion 25 of the ring member 21 having an approximately square shape when viewed from a plane is formed in a solid manner without having an inner space portion opened to the upper end thereof.

Other configurations are identical to those of the first embodiment including configurations that are not shown in FIGS. 7 and 8. For that reason, in the second embodiment, by the same reason as described in the first embodiment, the same action as the first embodiment is obtained, and the object of the present invention can be attained. That is, it is possible to provide a wristwatch in which the attachment work of the hour plate 31 to the ring member 21 and the rearrangement work of the hour plate 31 are easy, and the misattachment of the hour plate 31 due to the rearrangement of the hour plate 31 can be suppressed.

In addition, in the second embodiment, since the engagement convex portion 25 is a solid, the engagement convex portion 25 is hardly deformed when the hour plate 31 is attached or detached, and thus, it is possible to suppress that the misattachment of the hour plate 31 is generated due to the rearrangement of the hour plate 31. In addition, since the configuration of the engagement convex portion 25 is simple and the configuration of the molding die, which molds the ring member 21, is also simple, it is possible to expect a cost reduction due to a reduction in mold cost.

Figure 9:
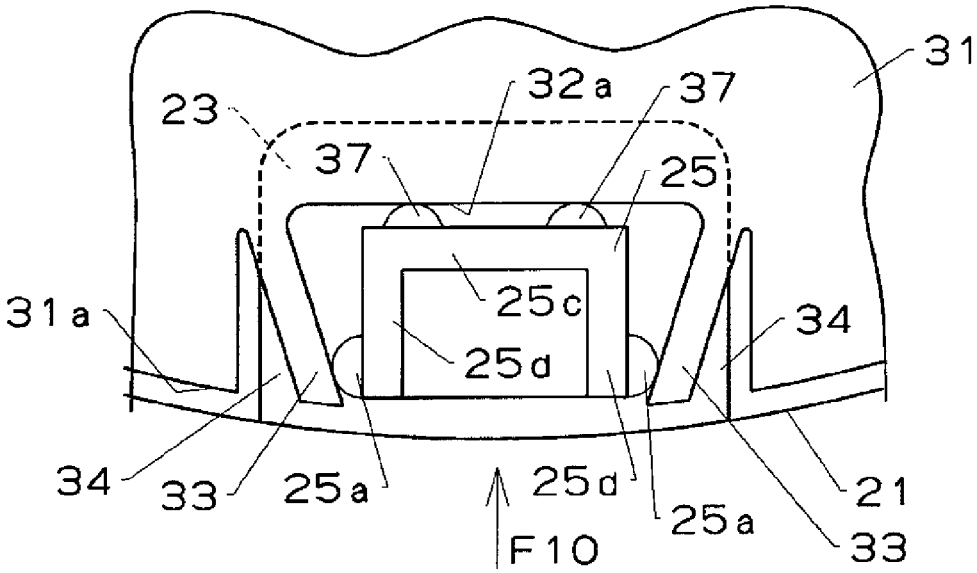
FIG. 9 is a plan view corresponding to FIG. 3 that shows a part of a wristwatch according to a third embodiment of the present invention.
Figure 10:
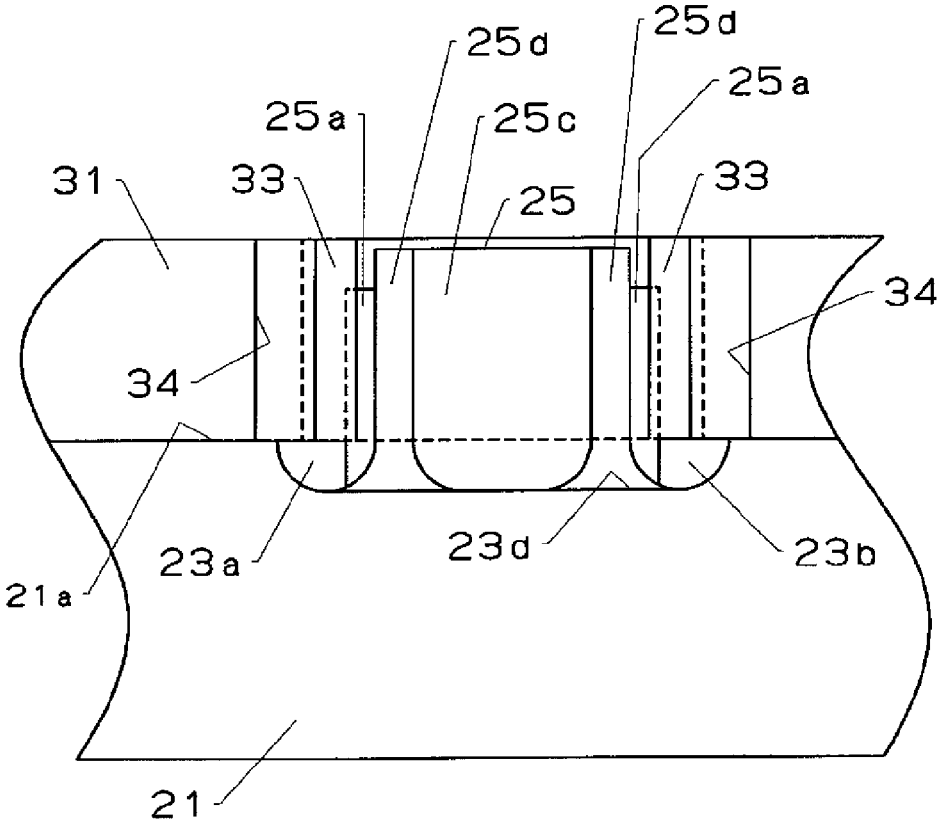
FIG. 10 is a side view viewed from an arrow F10 line direction in FIG. 9.

FIGS. 9 and 10 show a third embodiment of the present invention. A wristwatch according to the third embodiment is the same as the first embodiment including configurations not shown in FIGS. 9 and 10 except for configurations described below. For that reason, the same configurations as the first embodiment are denoted by the same reference numerals as the first embodiment, and the descriptions thereof will be omitted.

In the third embodiment, the engagement convex portion 25 has a wall portion 25*c* facing the groove bottom surface 32*a* of the convex portion accommodation groove 32 and other wall portions 25*d* that are provided so as to be bent from both end portions of the wall portion 25*c* in the width direction toward the open end of the convex portion accommodation groove 32, respectively and face each other. The engagement convex portion 25 is formed in an approximately U shape when viewed from a plane, in other words, a groove shape. Contact parts 25*a* are provided in the end portions of the open end sides of other wall portions 25*d*, and the contact parts 25*a* are integrally formed on the external surfaces of the end portions and are formed by beads that also ride in a vertical direction.

Configurations other than those described above are the same as the first embodiment including configurations not shown in FIGS. 9 and 10. For that reason, in the third embodiment, by the same reason as described in the first embodiment in advance, the same action as the first embodiment is obtained, and the object of the present invention can be attained. That is, it is possible to provide a wristwatch in which the attachment work of the hour plate 31 to the ring member 21 and the rearrangement work of the hour plate 31 are easy, and it is possible to suppress the misattachment of the hour plate 31 due to the rearrangement of the hour plate 31 that is a display plate.

In addition, in the third embodiment, in addition to the elastic deformation of the interposition portion 33, other wall portions 25*d* provided with the contact parts 25*a* of the engagement convex portions 25 can be bent (can be elastically deformed) so as to be fallen in a direction approaching each other. For this reason, due to the fact that, when the hour plate 31 is attached or detached, the interposition portion 33 of the hour plate 31 is mainly elastically deformed, and other wall portions 25*d* are also elastically deformed, it is possible to more easily perform the attachment and detachment work of the hour plate 31.

Furthermore, other wall portions 25*d* can be elastically deformed, despite that the ring member 21 and the hour plate 31 are different from each other in hardness, it is difficult for the interposition portion 33 to cut the contact part 25*a* of the engagement convex portion 25. For that reason, since it is difficult to reduce the force by which the interposition portions 33 interpose the engagement convex portion 25 therebetween, like a case where the contact part 25*a* is cut, it is desirable to hold the hour plate 31 so as not to rattle to the ring member 21.

Furthermore, by the configuration in which the contact portion 25*a* is formed by a bead, since the contact location with the slope interposition portion 33 slightly deviates from the tip of the interposition portion 33 to the root side, it is possible to heighten reliability of the stopper function of the engagement convex portion 25 that is exhibited when the hour plate 31 tries to be moved in the radial direction of the hour plate 31 connecting two convex portion accommodation grooves 32. Furthermore, the configuration, in which the contact part 25*a* is formed by the bead, can also be applied to the first and second embodiments and a fourth embodiment described later.

Figure 11:
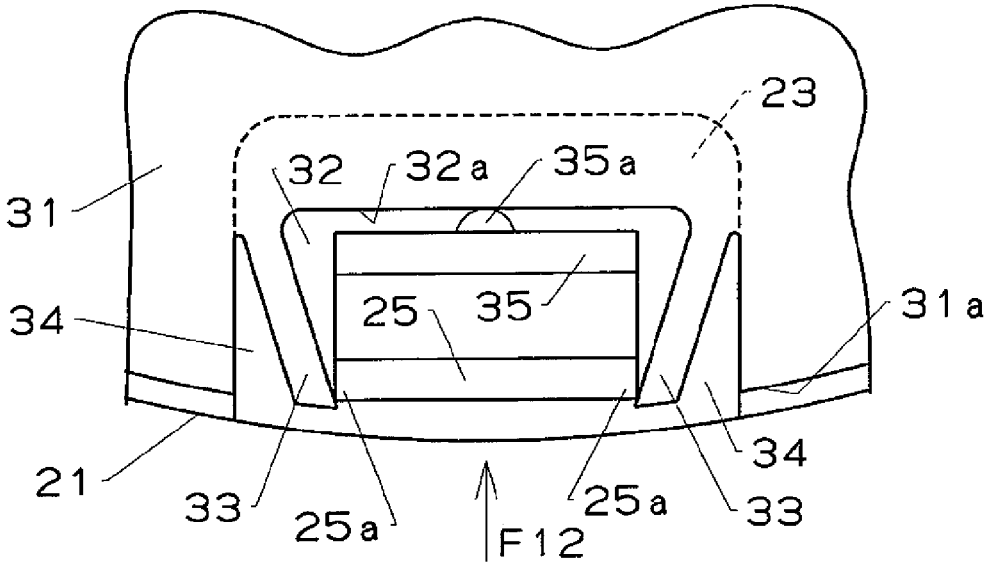
FIG. 11 is a plan view corresponding to FIG. 3 that shows a part of a wristwatch according to a fourth embodiment of the present invention.
Figure 12:
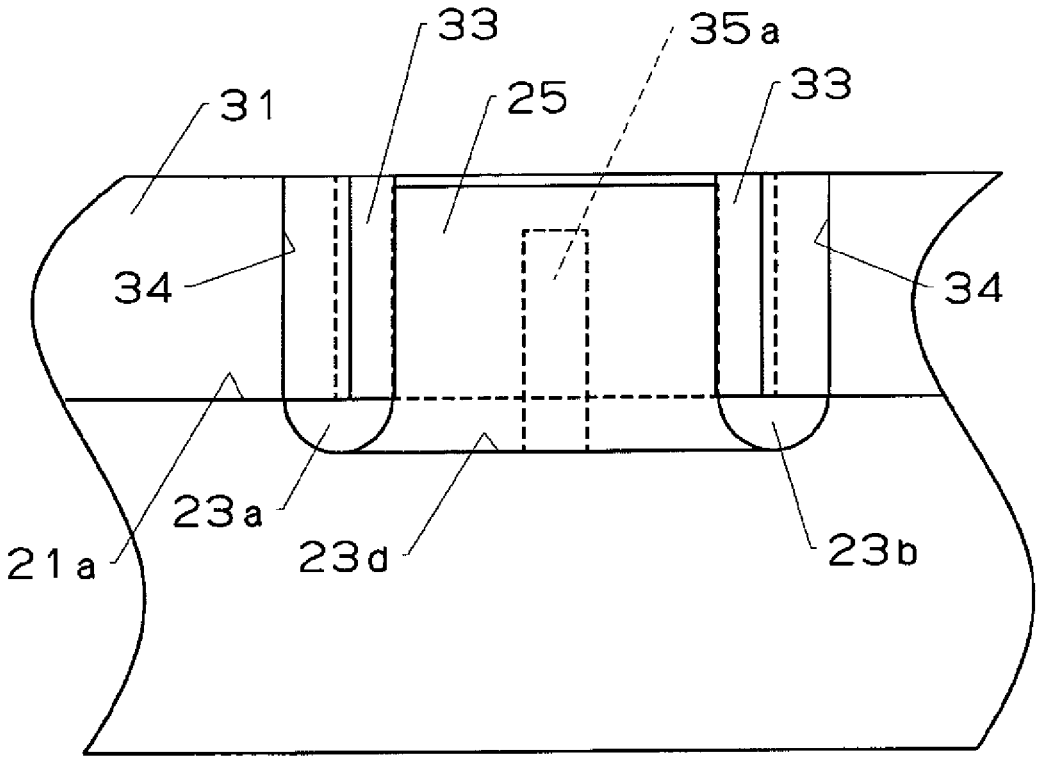
FIG. 12 is a side view viewed from an arrow F12 line direction in FIG. 11.

FIGS. 11 and 12 show a fourth embodiment of the present invention. A wristwatch according to the fourth embodiment is the same as the third embodiment including configurations not shown in FIGS. 11 and 12 except for configurations described below. For that reason, the same configurations as the first embodiment are denoted by the same reference numerals as the first embodiment, and the descriptions thereof will be omitted.

In the fourth embodiment, the engagement convex portion 25 of the ring member 21 is parallel to the groove bottom surface 32*a* of the convex portion accommodation groove 32 and is formed by a plate-like wall that can be elastically deformed in the radial direction of the ring member 21. Both end portions of the engagement convex portion 25 in the width direction are contact parts 25*a*. Furthermore, in the ring member 21, an upward restriction convex portion 35 is provided between the engagement convex portion 25 formed of a plate-like wall and the groove bottom surface 32*a* of the convex portion accommodation groove 32 with the same accommodated therein. The restriction convex portion 35 can elastically be deformed in the diameter direction of the ring member 21. The restriction convex portion 35 has a contact portion 35*a* constituted by a bead coming into contact with the groove bottom surface 32*a* of the convex portion accommodation groove 32. The contact portion 35*a* is provided so as to obtain the same function as the bead 27 described in the first embodiment.

Configurations other than those described above are the same as the first embodiment including configurations not shown in FIGS. 11 and 12. For that reason, in the fourth embodiment, by the same reason as described in the first embodiment in advance, the same action as the first embodiment is obtained, and the object of the present invention can be solved. That is, it is possible to provide a wristwatch in which the attachment work of the hour plate 31 to the ring member 21 and the rearrangement work of the hour plate 31 are easy, and it is possible to suppress the misattachment of the hour plate 31 due to the rearrangement of the hour plate 31.

In addition, in the fourth embodiment, when the hour plate 31 is attached or detached, in addition to the elastic deformation of the interposition portion 33, the engagement convex portion 25 can be elastically deformed in the radial direction of the ring member 21, whereby it is possible to more easily perform the attachment and detachment work of the hour plate 31. Furthermore, since the engagement convex portion 25 can be elastically deformed, despite that the ring member 21 and the hour plate 31 are different from each other in hardness, the contact part 25*a* of the engagement convex portion 25 is hardly cut by the interposition portion 33. For that reason, since force by which the interposition portions 33 interpose the engagement convex portion 25 therebetween is not reduced, like a case where the contact part 25*a* is cut, it is desirable to hold the hour plate 31 so as not to rattle to the ring member 21. Furthermore, since the configuration of the engagement convex portion 25 is simple like a plate-like form, it is possible to expect a reduction in cost due to a reduction in mold cost of the molding die which molds the ring member 21.

In addition, the present invention is not limited to the respective embodiments mentioned above. For example, it is possible to use a light emitting panel instead of the solar battery panel in the respective embodiments mentioned above. In the light emitting panel, for example, a panel formed from an electroluminescence element can suitably be used, and the light emitting panel emits light by the electric power that is supplied from a secondary battery or the like equipped in a timepiece exterior assembly. In this case, the light emitting panel emits light by the electric conduction thereto, the backlight illumination to the display plate is generated by the light emitting panel, and thus, the visibility of the display of the time or the like can be further improved. Furthermore, the present invention can also be applied to a pocket watch or the like besides the wristwatch.

What is claimed is:

1. A timepiece comprising:

a module;

a panel that is fixed onto the module;

a ring member of a ring shape when viewed from a plane that is fixed to a peripheral portion of the module, upward engagement convex portions being formed in a plurality of locations of the ring member, and the engagement convex portions having contact parts that are placed near an outer peripheral surface of the ring member; and a display plate that is disposed so as to cover the panel, has a plurality of convex portion accommodation grooves opened to a peripheral surface of the display plate, and a plurality of interposition portions which divides the accommodation grooves, comes into close contact with the contact part in the state of being elastically deformed, and interposes the engagement convex portions therebetween along a direction perpendicular to a radial direction of the ring member, the respective convex portion accommodation grooves being housed in the respective engagement convex portions and the display plate being attached to the ring member.

2. The timepiece according to claim 1, wherein the convex portion accommodation grooves are formed so that a distance between the interposition portions with the engagement convex portion interposed therebetween is narrowed as going to a peripheral surface side of the display plate.

3. The timepiece according to claim 1, wherein the display plate further has a plurality of relief grooves that is opened to the peripheral surface of the display plate, and portions between the relief grooves and the convex portion accommodation grooves are the interposition portions.

4. The timepiece according to claim 1, wherein the engagement convex portions have an approximately square shape when viewed from a plane and are a solid.

5. The timepiece according to claim 1, wherein the engagement convex portions have inner space portions that have an approximately square shape when viewed from a plane and are opened to an upper end.

6. The timepiece according to claim 1, wherein the engagement convex portions have a wall portion which faces the groove bottom surfaces of the convex portion accommodation grooves, and another wall portion which is continued so as to be bent from both end portions of the wall portion in a width direction toward the open ends of the convex portion accommodation grooves, and the contact part is provided in another wall portion.

7. The timepiece according to claim 1, wherein the engagement convex portions are formed by a plate-like wall that is parallel to the groove bottom surfaces of the convex portion accommodation grooves and can be elastically deformed in the radial direction of the ring member.

8. The timepiece according to claim 1, wherein the engagement convex portions come into contact with the groove bottom surfaces of the convex portion accommodation grooves.

9. The timepiece according to claim 7, wherein the ring member further includes upward restriction convex portions that are provided between the groove bottom surfaces of the convex portion accommodation grooves and the engagement convex portions, can be elastically deformed in the radial direction of the ring member, and come into contact with the groove bottom surfaces of the convex portion accommodation grooves.

10. The timepiece according to claim 1, wherein the panel is a solar battery panel that generates electricity by a photoelectric conversion.

11. The timepiece according to claim 1, wherein the panel is a light emitting panel that emits light in an electrically conducted state.

* * * * *